United States Patent [19]

Vander Hooven et al.

[11] 4,053,112

[45] Oct. 11, 1977

[54] CORN COB PROCESSING APPARATUS AND METHOD

[75] Inventors: David I. B. Vander Hooven, Maumee; Jacobus Johan Van der Zwan, Holland; James L. Logston, Perrysburg; Carl E. Pennington, Swanton, all of Ohio

[73] Assignee: The Andersons, Maumee, Ohio

[21] Appl. No.: 424,369

[22] Filed: Dec. 13, 1973

[51] Int. Cl.[2] ..... B02C 7/00; B02C 17/02; B02C 13/00; B02B 5/02

[52] U.S. Cl. ..... 241/24; 241/29; 241/76; 241/80

[58] Field of Search ..... 99/484, 623; 241/23, 241/24, 29, 76, 77, 78, 80

[56] References Cited

U.S. PATENT DOCUMENTS

| | | | |
|---|---|---|---|
| 291,231 | 1/1884 | Sanford | 241/78 |
| 1,598,328 | 8/1926 | Truax | 241/23 |
| 3,766,847 | 10/1973 | Palyi | 99/484 |

*Primary Examiner*—Harvey C. Hornsby
*Assistant Examiner*—Robert Pous
*Attorney, Agent, or Firm*—Richard D. Emch

[57] ABSTRACT

The invention is directed to a method and apparatus for processing shelled corn cobs. The cobs are graded, aspirated, and crushed for reducing the length of the cobs to between ½ inch and 3 inches. A second aspirator removes any remaining husks and hammer mills reduce the corn cobs into ⅛ inch to ½ inch pieces. The pieces are graded and oversized pieces are returned to a hammer mill while the remaining pieces are dried in a drier to reduce their moisture content. After grading, a portion of the pieces are sent through an attrition mill to further reduce the size of the pieces. After aspirating, the pieces are processed through roller mills to further reduce the size of the pieces and then passed through an attrition mill and graded into final product sizes.

12 Claims, 2 Drawing Figures

CORN COB PROCESSING APPARATUS AND METHOD

BACKGROUND OF THE INVENTION

Corn cob products have been known in the art for many years and new uses are developed each year. Corn cob proucts are used for abrasives, face powder compositions, animal bedding, absorbents for removing oil spills from the surfaces of bodies of water, as a cellulosic raw material for the molding of furniture components, as carrier for agricultural chemicals, pesticides, etc., and many other uses.

Apparatus and various processes for reducing the raw material corn cobs on a commercial basis are also known in the art. For example, Bulletin AIC 336 of the U.S. Department of Agriculture, published in May 1952, discusses various apparatus and processing steps.

It has been found that since the publication of the above-identified bulletin, the processing of corn cobs has become more and more complex as the market expands into many different fields. Problems have arisen in the processing of cobs for different markets.

As is well known, the cob is divided into several parts, namely, the chaff, the woody ring and the pith. While each of these parts are cellulosic in nature, their physical properties are quite different. For example, the woody ring portion is quite dense and is most adaptable to abrasive type products, while other components are used for animal feed.

Another problem which has been found in the industry is that the raw materials, namely the corn cobs themselves, are becoming much more difficult to obtain. While at one time the raw material was strictly a "waste product" from the food industry, at the present time the corn cob itself has become more and more important while the source of the raw material is much less plentiful.

It is therefore important that the process of reducing corn cobs becomes more efficient and that the final product becomes more uniform, clean, and dependable.

SUMMARY OF THE INVENTION

The present invention solves many of the problems found in the art and provides an improved apparatus and process for reducing corn cobs. While many of the apparatus components are individually well known in the art, the present overall apparatus and process is an important improvement in the processing or reducing of corn cobs.

Initially, the cobs are graded, stone and tramp metal removed, aspirated and crushed for reducing the length of the cobs to between ¼ inch and 3inch. Further aspiration removes any remaining husks and hammer mills reduce the size of the corn cobs into ⅜ inch to ½ inch pieces. The corn cob pieces are graded and oversized pieces are returned to a hammer mill while the remaining pieces are dried in a drier to reduce their moisture content. After a further grading operation, the smaller pieces are removed and the larger pieces are sent through an attrition mill to further reduce their size. After aspiration, the pieces are sent through roller mills which shear the pieces into smaller sizes. The resulting pieces are then rounded and graded into final product sizes.

DESCRIPTION OF THE PREFERRED EMBODIMENT

Figure 1:
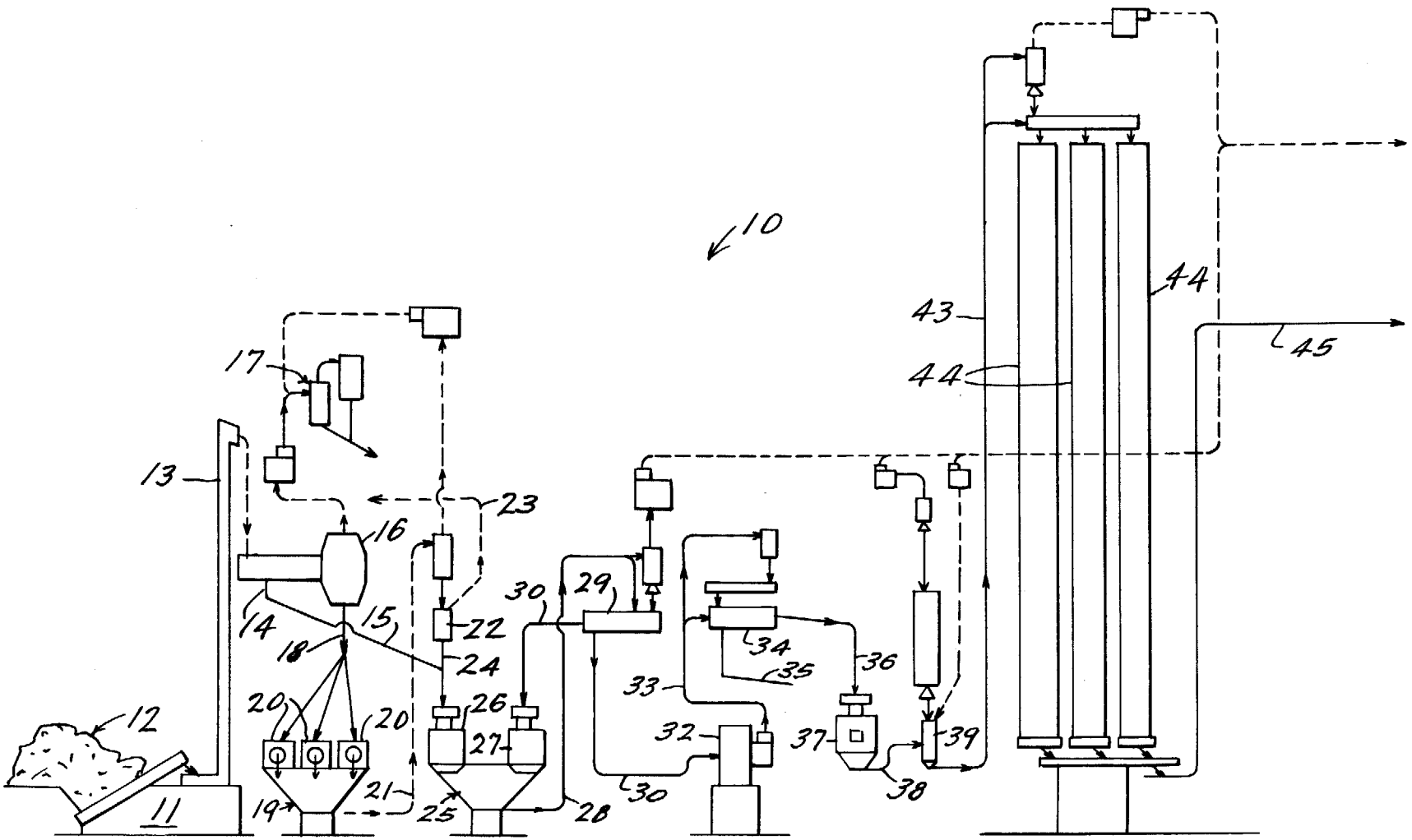
FIG. 1 is a diagrammatic side elevational view of apparatus and method steps relating to an improved corn cob processing operation, according to the present invention.
Figure 2:
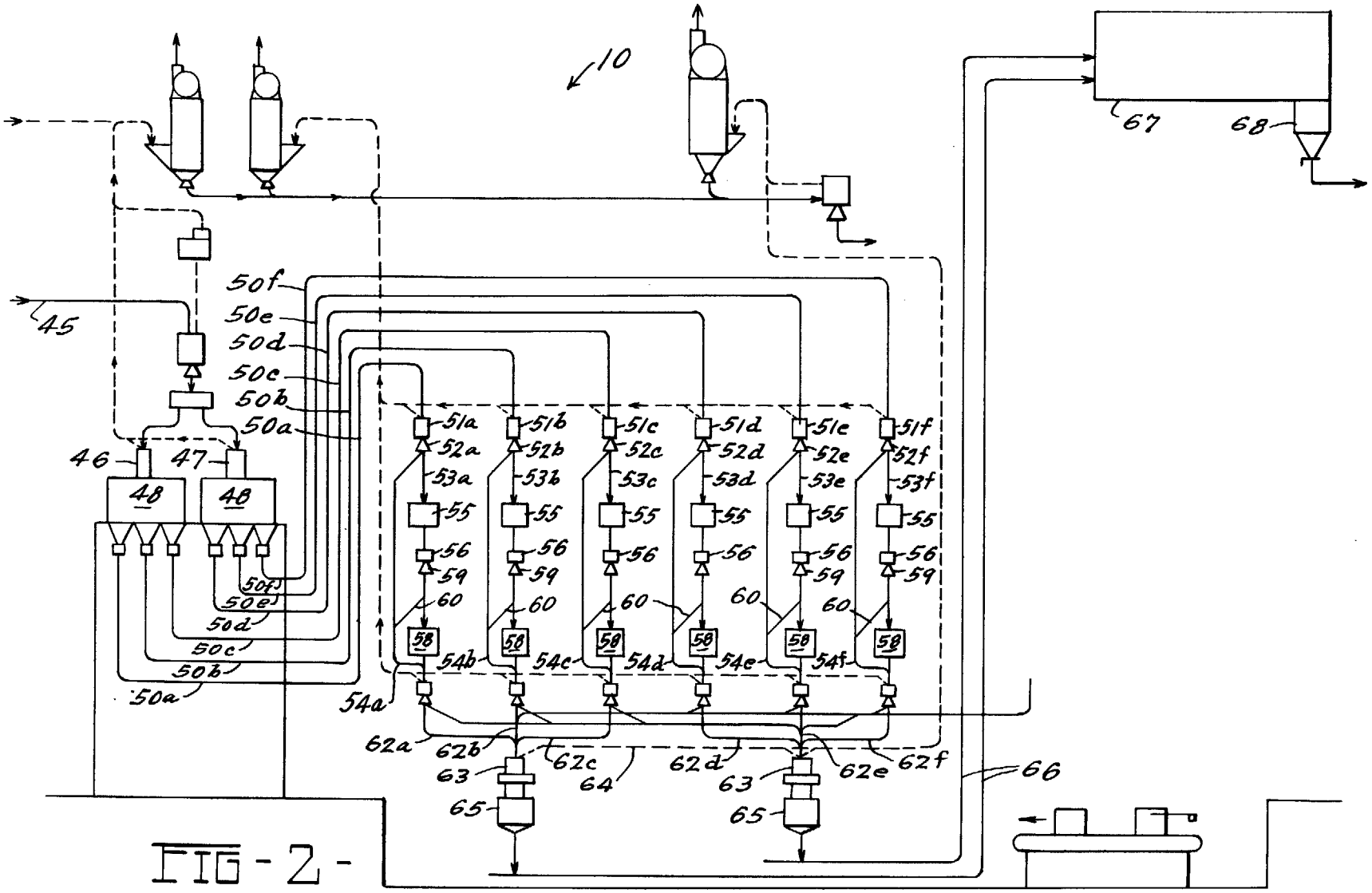
FIG. 2 is a view similar to FIG. 1 and showing the remainder of the present processing operation.

Corn cob apparatus, according to the present invention, is generally indicated in FIGS. 1 and 2 by the reference number 10. Referring to FIG. 1, the corn cob apparatus 10 includes a raw material hopper 11 which receives shelled corn cobs, generally indicated by the reference number 12. In the present embodiment, the shelled corn cobs 12 are moved by a conveyor 13 and discharged into a screen grader 14. The screen grader 14 removes most of the lighter components which are discharged to a conveyor 15. Material on the top of the screen of the screen grader 14 is agitated to separate the husks from the cobs 12. The cobs 12 then are introduced into an aspirator 16. Air pressure within the aspirator 16 drives the husks and other trash into a trash system 17. The whole cobs 12 move through a conveyor system 18 into a mechanical crusher apparatus 19, which includes three mechanical crushers 20.

The mechanical crushers 20 break the whole cobs 12 into lengths of between ¼ inch and 3inches. The crushers 20 also loosen the remaining husks. The crushers 20 accomplish reduction of the cobs by introducing the cobs 12 between a revolving cylinder having outwardly extending knobs on its surface and a stationary cutter bar having slots which receive the knobs. The size of the cobs 12 are now such that they can be transported by a pneumatic conveyor 21 to an aspirator 22. The aspirator 22 is a cascading type of aspirator which removes any remaining husks. The cascading aspirator 22 comprises a vertically extending chute having a plurality of inclined baffles spaced on opposed sides of the chute. An exhaust suction fan induces ambient air upwardly through the chute. As the cob pieces move downwardly and are distributed and slowed by the baffles, the updraft of air entraps the lighter components and waste particles which are removed. The trash components move on a conveyor 23 to the trash system 17. The cleaned portions of the cob move through a conveyor 24 into hammer mill apparatus 25 which includes hammer mills 26 and 27. The hammer mills 26 and 27 are built for the reduction of moderately hard, tough and fibrous substances to various degrees of fineness. As is known in the art, hammer mill reduction is accomplished largely by impact, although there is some grinding action and some attrition of particles upon one another. It is noted that the lighter components from the conveyor 15 are reintroduced into the conveyor 24 immediately above the hammer mill 26. A gravity separator is positioned before the hammer mill 26 to remove stones and other non-ferrous waste materials together with a magnet to remove ferrous materials. The hammer mill 26 reduces the size of the cobs 12 to a predetermined size of between ⅜ inch and ½ inch. A pneumatic conveyor 28 transports the cob pieces to a second screen grader 29. All cob pieces over ⅜ inch are recycled through a conveyor 30 into the hammer mill 27 for additional reduction in size. All pieces under ⅜ inch are introduced into a conveyor 31 which transports the cob pieces to a rotary cob drier 32. The cob drier 32, which may be either gas or oil fired, reduces the moisture in the cob pieces to a maximum of 10%. Preferably, the cob drier 32 is a rotary drier. The dried cob pieces are then introduced into a conveyor 33 which leads to a third screen grader 34. Corn cob pieces that will pass through a ⅛ inch screen are removed through a conveyor 35 to a storage area (not shown). These lighter component pieces are graded as a No. 4 cob and are stored separately. Pieces over ⅛ inch are transferred by a conveyor 36 to an attrition mill 37. A non-ferrous and ferrous waste removal apparatus is positioned before the attrition mill 37. The attrition or disk mill 37 further reduces the cob pieces to a predetermined size of approximately ¼ inch in diameter. The attrition or disk mill 37 also facilitates the removal of any lighter components which are still attached to the cob pieces. The attrition or disk mill 37 accomplishes reduction by a revolving plate or disk operating in the same plane as a second stationary plate or disk. The cob pieces are fed into the center of the second stationary disk and centrifugal force from the revolving disk forces the pieces between the disks to their outer peripheries. This rounds, tears loose lighter components and granulates the sharp edges of the particles into a more uniform granulation with a minimum of fines. From the attrition mill 37, the cob pieces pass through a conveyor 38 to an aspirator 39. The aspirator 39 is a cascading type of aspirator which removes lighter components and dust. These components are removed from the system and the cob pieces are transported by a conveyor 43 to a plurality of storage bins 44. The ¼ inch cob pieces are removed from the storage bins 44 and transferred by a conveyor 45 to cascading type aspirators 46 and 47. It is noted that the storage bins 44 may be removed from the system and transfer made directly from the aspirator 39 through the conveyor 45 to the aspirators 46 and 47.

The aspirators 46 and 47 remove lighter components from the cob pieces. The lighter components comprise small particles of pith and beeswing which are collected and sold. The remaining pieces are transferred downwardly through surge bins 48 into a plurality of conveyors 50. The conveyors 50 have been designated **50*a*–50*f* and communicate with a plurality of cascading type aspirators 51*a*–51*f*. After passing through the aspirators 51*a* through 51*f*, the corn cob pieces pass through valves 52*a*–52*f* and into conveyors 53*a*–53*f*. Bypass conveyors 54*a*–54*f* are provided and by controlling the valves 52*a*–52*f*, the corn cob pieces may be directed in various proportions through the conveyors 53 and the bypass conveyors 54. Normally, the cob pieces pass through the conveyors 53*a* into first double roller mills 55. The double roller mills or shearing means 55 shear each piece into smaller pieces of predetermined sizes. For example, the ¼ inch pieces are reduced in the roller mills 55 to pieces approximately 3/16inch in diameter. The pieces then pass through aspirators 56 downwardly into a second set of double roller mills 58. The double roller mills 58 further reduce the size of the particles to predetermined sizes. For example, the double roller mills or shearing means 58 reduce the particle size from approximately 3/16inch in diameter to particles of between ⅛ inch and 1/16inch in diameter. The roller mills 55 and 58 are used for single stage shearing where uniform granulation with minimal fines is important. Cob particles flow from the mill input channel to the shearing rolls. The shearing rolls comprise a single pair of parallel rolls which are rotating at different speeds. The particles are introduced at the nip of the parallel rolls. Often two pairs of parallel rolls are horizontally spaced from one another in the roller mill housing and the cob particles from the input channel are divided into two streams with each stream being directed to one of the pairs of parallel rolls. Valves 59 and bypass conveyors 60 are provided to bypass at least all or a part of the corn cob pieces directed toward the second set of double roller mills 58. Therefore, the valves 52 and 59 together with the bypass conveyors 54 and 60 provide means for directing all or a portion of the corn cob pieces through the first set of double roller mills 55, and then having all or a portion of those cut particles pass through the second set of double roller mills 58**.

Conveyors 62 then direct the cob particles through aspirators 63. Lighter components are sent from the aspirator 63 through a conveyor 64 while the cob particles are directed downwardly through disk attrition mills 65. The disk attrition mills 65 round the corn cob pieces or particles into more granular shapes. The corn cob particles are then introduced into conveyors 66 to a final grading apparatus 67. The final grading apparatus 67 is not shown in detail but is known in the art and consists of multiple screen grading apparatus and conveyors. By utilizing the discharges from the individual screens and combining them with various discharges, the final corn cob particles may be graded into final particle sizes after passing through a final aspirator 68. The final particles are then either bulk stored or bagged for distribution. It is noted that the final corn cob particles are approximately 99% woody ring components.

It has been found that the apparatus and method according to the present invention solves many of the problems found in the prior art and results in an efficient corn cob processing operation.

What I claim is:

1. Apparatus for processing shelled corn cobs comprising, in combination, first grader means for grading the shelled corn cobs and removing lighter components, first aspirating means in communication with said first grader means for removing husks from the corn cobs, crusher means communicating with said first aspirating means for reducing the size of the corn cobs to between ½ inch and 3inches in length, said crusher means comprising a revolving cylinder crusher, second aspirating means in communication with said crusher means for removing any remaining husks from the corn cobs, hammer mill means in communication with said second aspirating means for reducing the corn cobs into ⅜ inch to ½ inch pieces, second grader means in communication with said hammer mill means for grading said pieces to a first predetermined size, wherein pieces over such size are returned to said hammer mill means, cob drier means for receiving corn cob pieces under such first predetermined size and drying such pieces to a predetermined moisture content, third grader means for removing corn cob pieces under a second predetermined size, attrition mill means for receiving corn cob pieces over such second predetermined size and reducing such pieces to a third predetermined size, third aspirating means in communication with said attrition mill means for further removal of lighter components and dust from such pieces, shearing means in communication with said third aspirating means for reducing the size of such pieces to a fourth predetermined size, attrition mill means in communication with said shearing means for rounding the pieces to a granular shape, and fourth grader means for grading such pieces into final product sizes.

2. Apparatus, according to claim 1, wherein said first grader means comprises a screen grader.

3. Apparatus, according to claim 1, wherein said first aspirating means includes a trash removal port.

4. Apparatus, according to claim 1, wherein said crusher means comprises three mechanical crushers.

5. Apparatus, according to claim 1, wherein said second aspirating means comprises a cascading type aspirator.

6. Apparatus, according to claim 1, wherein said hammer mill means comprises two hammer mills.

7. Apparatus, according to claim 1, wherein said cob drier means comprises a rotary drier and such predetermined moisture content is a maximum of 10%.

8. Apparatus, according to claim 1, wherein said second and third grader means comprise screen type graders.

9. Apparatus, according to claim 1, wherein said shearing means comprises first and second roller mills.

10. A corn cob processing method for the reduction and treating of shelled corn cobs, comprising the steps of, initially grading the shelled corn cobs, mechanically crushing the cobs to pieces ½–3inches 3inches in length, removing a portion of the trash components including husks, reducing the cobs to pieces ⅜–½ inch, grading the pieces, wherein pieces under ⅜ inch are directed toward a drier and pieces over ⅜ inch are recycled, drying the cobs to a predetermined moisture content, grading the pieces, wherein pieces under ⅛ inch are removed and pieces over ⅛ inch, are directed onward, reducing the pieces to approximately ¼ inch, aspirating and cascading the pieces to remove lighter components and dust, shearing the pieces to reduce the size of the pieces, rounding the pieces to a granular shape and grading the pieces to final product sizes.

11. A corn cob processing method, according to claim 10, wherein the predetermined moisture content is a maximum of 10%.

12. A corn cob processing method, according to claim 10, wherein after the initial grading of the shelled corn cobs, the cobs are aspirated to remove husks from the cobs.

* * * * *